US006238035B1

(12) United States Patent
Barinaga

(10) Patent No.: US 6,238,035 B1
(45) **Date of Patent: *May 29, 2001**

(54) INDEXING SCRAPER CLEANING METHOD AND SYSTEM FOR INKJET PRINTHEADS AND PRINTING MECHANISM INCLUDING THE SYSTEM

(75) Inventor: John A. Barinaga, Portland, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/495,433

(22) Filed: Jan. 31, 2000

(51) Int. Cl.[7] ..... B41J 2/165
(52) U.S. Cl. ..... 347/28; 347/33
(58) Field of Search ..... 347/33, 22, 28; 15/256.5; 400/701; 101/423

(56) References Cited

U.S. PATENT DOCUMENTS

| | | | | |
|---|---|---|---|---|
| 4,935,753 | * | 6/1990 | Lehmann et al. | 347/33 |
| 5,051,758 | * | 9/1991 | Markham | 347/28 |
| 5,115,250 | * | 5/1992 | Harmon et al. | 347/33 |
| 5,614,930 | | 3/1997 | Osborne et al. . | |
| 5,815,176 | | 9/1998 | Rotering | 347/33 |
| 5,896,145 | | 4/1999 | Osborne et al. . | |
| 5,949,448 | | 9/1999 | Man et al. . | |
| 5,980,018 | | 11/1999 | Taylor et al. . | |

FOREIGN PATENT DOCUMENTS

| | | | | |
|---|---|---|---|---|
| 3236763 A1 | * | 4/1984 | (DE) | B41J/3/04 |
| 0 437 361 | | 7/1991 | (EP) . | |
| 404278358 | | 10/1992 | (JP) . | |

OTHER PUBLICATIONS

Hewlett–Packard Company Patent Application filed Jul. 3, 1996, Ser. No. 08/667,611, entitled "Integrated Translational Service Station for Inkjet Printheads".
Hewlett–Packard Company Patent Application filed Oct. 29, 1997, Ser. No. 08/960,587, entitled "Hide–Away Wiper Scraper for Inkjet Printheads".
Hewlett–Packard Company Patent Application filed Apr. 30, 1999, Ser. No. 09/302,909, entitled "Multi–Faceted Wiper Scraper System for Inkjet Printheads".
Hewlett–Packard Company Patent Application filed Oct. 27, 1999, Ser. No. 09/428,680, entitled "Dual Wiper Scrapers for Incompatible Inkjet Ink Wipers".
Hewlett–Packard Company Patent Application filed Oct. 28, 1999, Ser. No. 09/428,892, entitled "Screen Wiper Scraper System for Inkjet Printheads", now abandoned.

* cited by examiner

*Primary Examiner*—David F. Yockey
(74) *Attorney, Agent, or Firm*—Flory L. Martin

(57) ABSTRACT

An indexing wiper scraper cleaning system for cleaning a scraper, which has removed ink residue from a wiper following an inkjet printhead wiping routine where the residue was first removed from the printhead in an inkjet printing mechanism, has a reservoir filled with an ink solvent. Rotary scraper member having a series of scraper bars projecting radially from a cylindrical body is supported to periodically soak at least one of the scraper bars in the ink solvent bath. Following this soaking, the scraper bars are rotated through an indexing motion into a scraping position to scrape the ink residue from the wiper. After the scraping operation, the scraper bars are returned to the solvent bath to ready them for the next scraping operation. A method of cleaning an inkjet printhead, along with an inkjet printing mechanism having such a indexing wiper scraper cleaning system are also provided.

17 Claims, 11 Drawing Sheets

INDEXING SCRAPER CLEANING METHOD AND SYSTEM FOR INKJET PRINTHEADS AND PRINTING MECHANISM INCLUDING THE SYSTEM

FIELD OF THE INVENTION

The present invention relates generally to inkjet printing mechanisms, and more particularly to an indexing scraper system for removing ink residue from a wiper after cleaning the residue from an inkjet printhead.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads. This wiping must be accomplished without any appreciable wear that could decrease printhead life, and without using excessive forces that could otherwise un-seat the pen from the carriage alignment datums.

In the past, the printhead wipers have been a single or dual wiper blade made of an elastomeric material. Typically, the printhead is translated across the wiper in a direction parallel to the scan axis of the printhead. In one printer, the wipers were rotated about an axis perpendicular to the printhead scan axis to wipe. Today, most inkjet pens have nozzles aligned in two linear arrays which run perpendicular to the scanning axis. Using these earlier wiping methods, first one row of nozzles was wiped and then the other row of nozzles was wiped. While these earlier wiping methods proved satisfactory for the traditional dye based inks, unfortunately, they were unacceptable for the newer fast drying pigment inks.

One suitable service station design for pigment-based inks was a rotary device first sold in the DeskJet® 850C and 855C color inkjet printers, and later in the DeskJet® 820C and 870C color inkjet printers by Hewlett-Packard Company of Palo Alto, Calif., the present assignee. This rotary device mounted the wipers, primers and caps on a motor-operated tumbler. These pens were wiped using an orthogonal wiping technique, where the wipers ran along the length of the linear nozzle arrays, wicking ink along the arrays from one nozzle to the next to serve as a solvent to break down ink residue accumulated on the nozzle plate. A camming device moved a horizontal arm carrying a wiper scraper into position to clean ink residue from the wipers as they rotated past. The scraper arm had capillary channels formed along the under surface from the scraper tip to an absorbent blotter pad.

A translational or sliding orthogonal wiping system was first sold by the Hewlett-Packard Company in the DeskJet® 720C and 722C color inkjet printers. The wipers were slid under a stationary vertical, rigid plastic wiper bar to clean off any clinging ink residue. This wiper bar had an inverted T-shaped head which assisted in scraping the wipers clean. Another wiper system using rotational and vertical motion was first sold by the Hewlett-Packard Company in the DeskJet® 2000C Professional Series color inkjet printer. This was one of the first service station systems in a Hewlett-Packard Company inkjet printer to use an ink solvent, specifically polyethylene glycol ("PEG"), to clean and lubricate the printheads. This service station required two costly motors to operate the service station for moving the service station servicing components both vertically and rotationally. Another wiper system first sold by the Hewlett-Packard Company as the HP PhotoSmart color printer wipers with vertical capillary channels along each side surface of the wipers to allow the liquid ink residue to drain away from the wiper tip under the force of gravity and capillary forces.

In past service stations, accumulation of ink residue and other debris on the wiper scraper has limited the effective life during which the wiper scraper effectively cleans the wipers. Thus, to extend service station life and the overall printer life, maintaining wiper cleanliness is a critical limiting factor. Dirty wipers not only fail to adequately clean the printheads leading to print quality defects, but they also contaminate the ink solvent and plug the solvent applicator pores, leading to poor pen health.

Thus, while a variety of different wiper scraper systems have been proposed and implemented, a need still remains for a service station having a wiper scraper system which meets or exceeds the operational performance of its predecessors in maintaining printhead health, and yet which uses more economical components.

SUMMARY OF THE INVENTION

According to one aspect of the present invention, a wiper cleaning system for is provided for cleaning ink residue from a wiper which has wiped ink residue from an inkjet printhead in an inkjet printing mechanism. The cleaning system includes a frame and a scraper tumbler having a body pivotally supported by the frame and plural scraper bars projecting radially outward from the body member. The cleaning system also has a tumbler advancing mechanism which selectively advances the scraper bars to a scraping position where the wiper is scraped across a positioned one of the scraper bars.

According to one aspect of the present invention, a method is provided for cleaning ink residue from an inkjet printhead in an inkjet printing mechanism. The method includes the step of providing a wiper and a scraper tumbler having plural scraper bars projecting radially outward therefrom. In a wiping step, ink residue is wiped from an inkjet printhead with the wiper. In a rotating step, the scraper tumbler is rotated to place one of the scraper bars in a scraping position. The method includes the step of moving the wiper across the one of the scraper bars to scrape ink residue form the wiper.

According to a further aspect of the present invention, an inkjet printing mechanism may be provided with an indexing wiper scraper cleaning system as described above.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system.

Another goal of the present invention is to provide a wiping system for cleaning printheads in an inkjet printing mechanism to prolong printhead life.

Still another goal of the present invention is to provide a printhead wiping system for cleaning printheads in an inkjet printing mechanism, with the system having fewer parts that are easier to manufacture than earlier systems, and which thus provides consumers with a reliable, economical inkjet printing unit.

BRIEF DESCRIPTION OF THE DRAWINGS

FIGS. 4–7 are enlarged, side elevational views of the service station of FIG. 1 showing various stages of a pallet flip-down sequence, with:

FIG. 4 showing a first stage;

FIG. 5 showing a second stage;

FIG. 6 showing a third stage; and

FIG. 7 showing a fourth stage.

FIGS. 9–11 are enlarged, side elevational views of the service station of FIG. 1 showing various beginning stages of a pallet flip-up sequence, with:

FIG. 9 showing a first stage;

FIG. 10 showing a second stage;

FIG. 11 showing a third stage;

FIGS. 14–15 are enlarged, front elevational views of the service station of FIG. 1 showing the operation of a detent member which holds the pallet either upright for wiping or inverted for scraping, with:

FIG. 14 showing the pallet upright for wiping; and

FIG. 15 showing the pallet inverted for scraping.

DETAILED DESCRIPTION OF A PREFERRED EMBODIMENT

Figure 1:
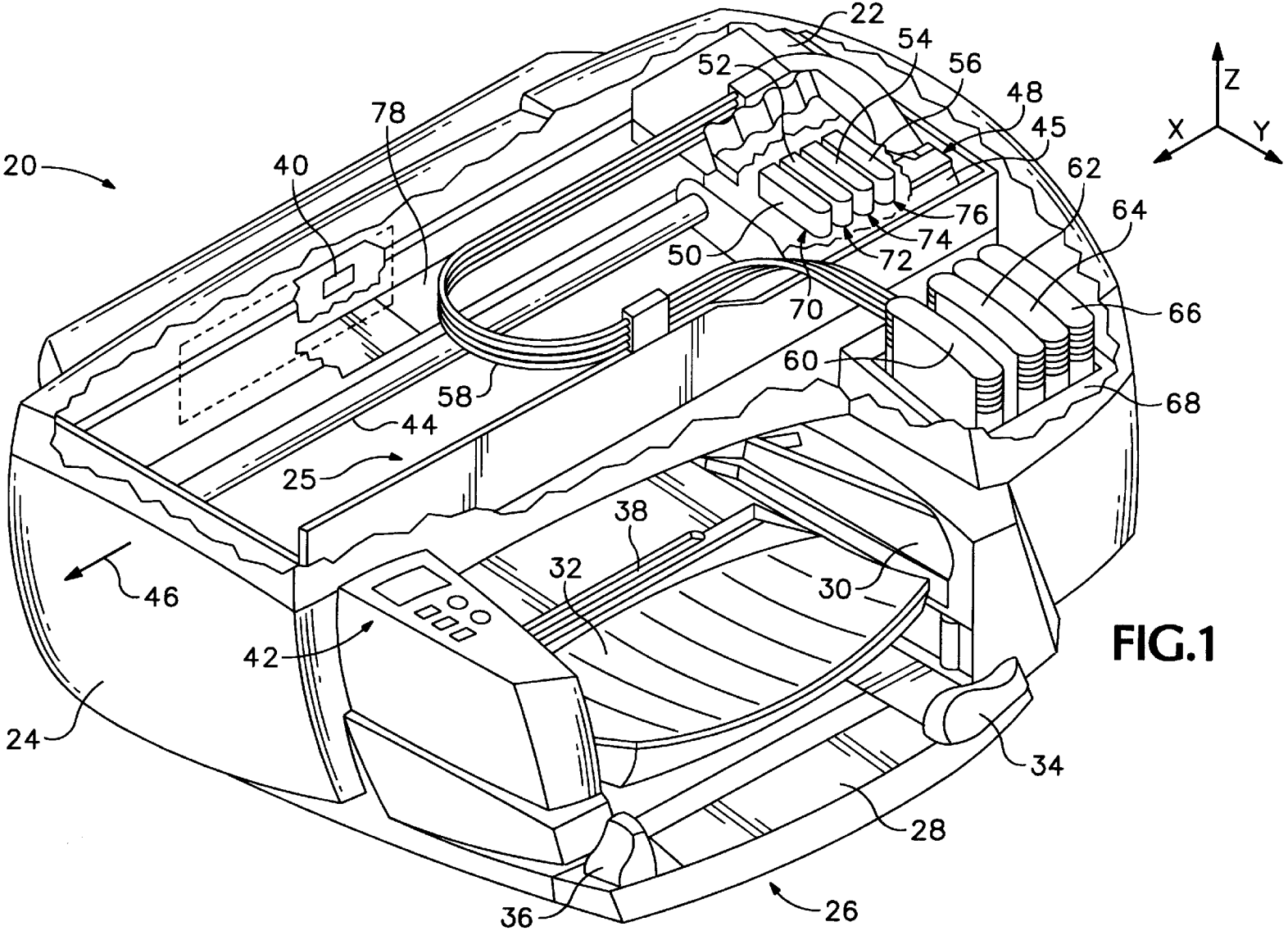
FIG. 1 is a perspective view of one form of an inkjet printing mechanism, here, an inkjet printer, including a printhead service station having one form of a flipping wiper scraper system of the present invention for removing ink residue from a wiper after cleaning the residue from an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a DC (direct current) motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

In the printzone 25, a media sheet receives ink from an inkjet cartridge, such as a black ink cartridge 50 and three monochrome color ink cartridges 52, 54 and 56, shown in FIG. 1. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52-56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to form an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag, arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Figure 2:
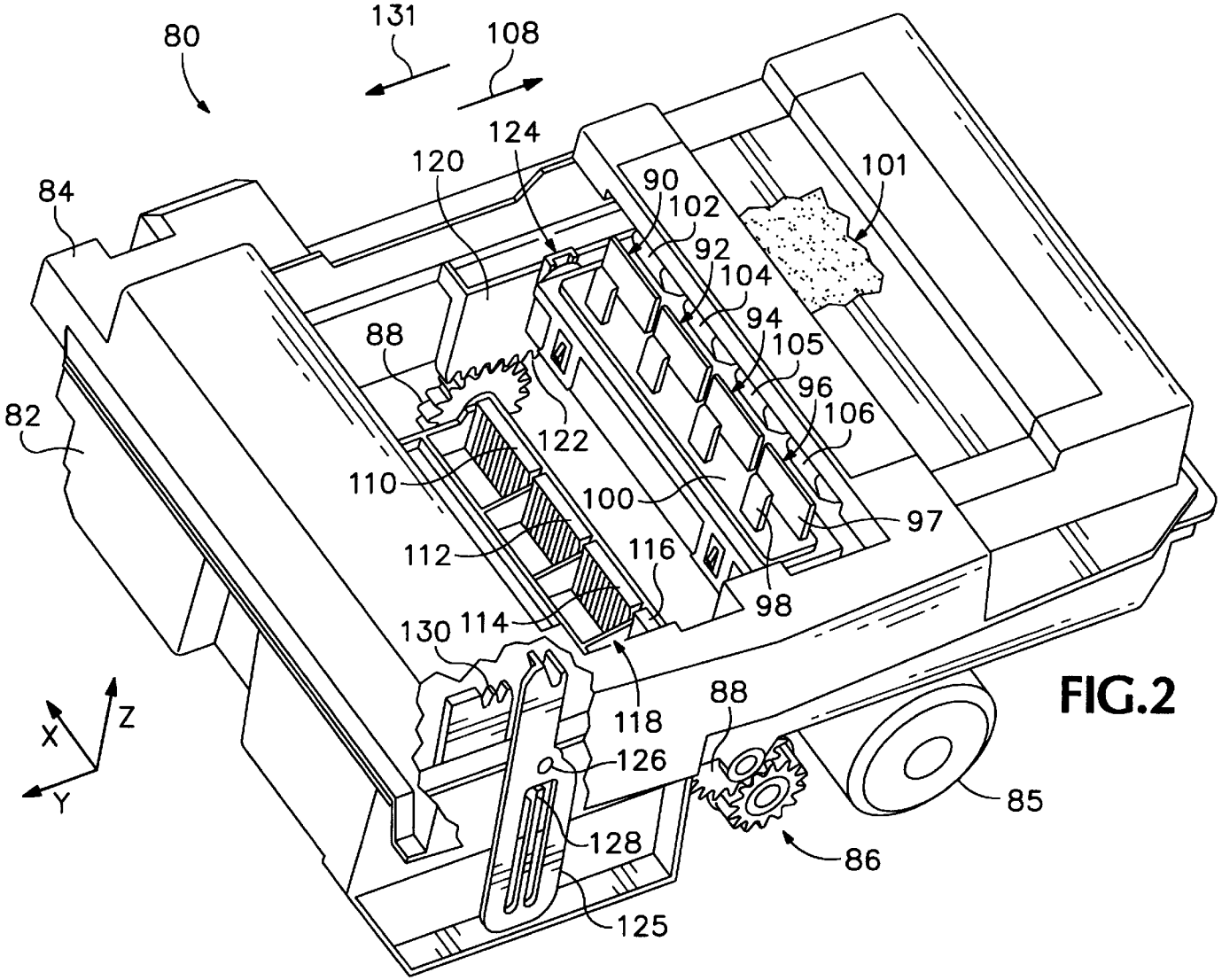
FIG. 2 is a perspective view of the service station of FIG. 1.

FIG. 2 shows one form of a flipping wiper scraper service station 80, constructed in accordance with the present invention. The service station 80 has a frame which includes a lower deck 82 and an upper deck 84, which may be joined together by screws, a snap fit, or other fastener devices. The frame lower deck 82 supports a service station motor 85, a gear assembly 86, and a spindle gear 88. The motor 85 drives the gear assembly 86, which in turn drives the spindle gear 88 to move various printhead servicing components into position to service each of the printheads 70–76 when in the servicing region 48. For example, four wiper 15 assemblies 90, 92, 94 and 96 are moved through the action of motor 85, gear assembly 86 and spindle gear 88, to wipe ink residue from the printheads 70, 72, 74 and 76. respectively. Each of the wiper assemblies 90–96 has a large wiper 97, which wipes across the entire orifice plate, and a dedicated nozzle wiper 98 which concentrates on the central nozzle region of the printhead. Each of the wiper assemblies 90–96 are supported by a flipping wiper sled 100, which operates as described further below.

Other servicing components may be also supported by the service station frame 82, 84. For instance, to aid in removing ink residue from printheads 70–76, an ink solvent is used, such as a hygroscopic material, for instance polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have a large molecular size which leads to a low, almost zero, vapor pressure. This ink solvent is stored in an ink solvent reservoir 101 which is supported along an interior surface of the frame upper deck 84. For the purposes of illustration, the preferred ink solvent used by the service station 80 is PEG, and the solvent reservoir 101 is divided into four separate reservoirs, one for each color (black, cyan, yellow and magenta) to prevent cross contamination of the colors at the reservoir 101. The ink solvent reservoir 101 is fluidically coupled to four solvent applicator pads 102, 104, 105 and 106, which apply ink solvent to the large wiper blades 97 of the wiper assemblies 90, 92, 94 and 96, respectively, when the sled 100 is moved in a rearward direction, as indicated by arrow 108.

A series of wiper scrapers, including scrapers 110, 112, 114 and 116 are supported by the frame lower deck 82 to remove ink residue from the wiper assemblies 90, 92, 94 and 96, respectively, after they have removed the residue from the printheads 70–76. Preferably, the wiper scrapers 110–116 are constructed as an integral scraper assembly 118, which is formed as a unitary member for ease of assembly and attachment to the frame lower deck 82. The details of construction of the scraper assembly will be described further below, along with several alternate embodiments for constructing the scraper assembly 118 (see FIGS. 16–19).

Figure 9:
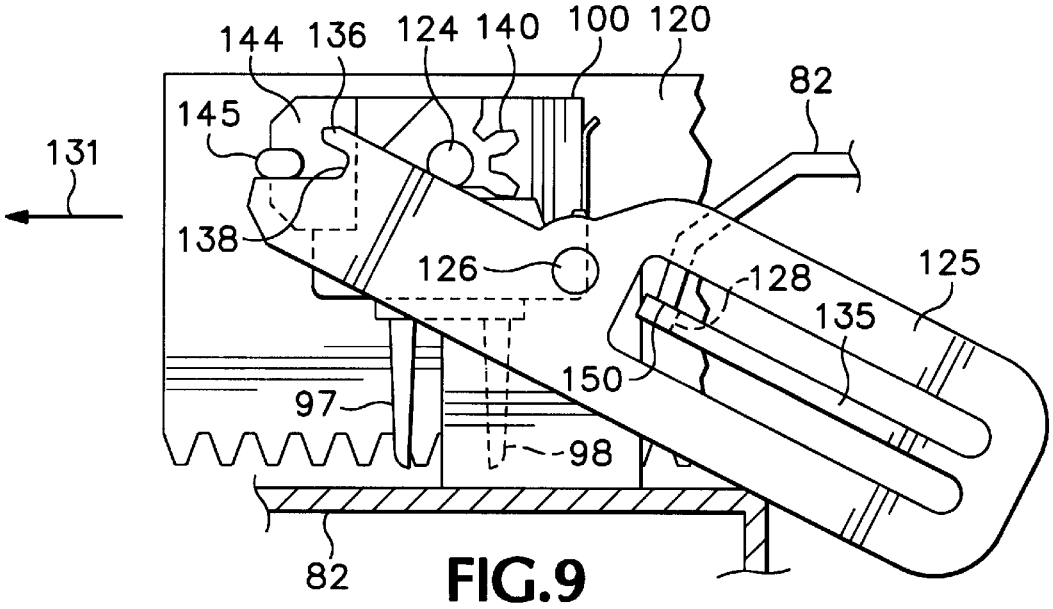

Another main component of the service station 80 is a moveable platform or pallet 120, which has a rack gear 122 that is engaged by the spindle gear 88 to be driven by motor 85 and gear assembly 86 in the positive and negative Y-axis directions. The wiper sled 100 is pivotally mounted to the pallet 120, for instance using shaft 124 which is seated in bushings formed in the pallet 120 (see FIGS. 14 and 15). To transition the wipers 90–96 from an inverted position, where they may be cleaned by the scrapers 110–116, to their upright wiping position shown in FIG. 2, the service station 80 includes a trip lever 125 which is pivotally mounted at post 126 to the exterior of the frame lower deck 82. To limit rotation of the trip lever 125 around post 126, the lever 125 includes a stop member 128, which engages a pair of stop features (described further below with respect to FIG. 9) molded into the lower deck 82. By forming the stop member 128 as a cut-out portion of the trip lever 125, the stop 128 has a spring action, which serves to damp operation of the trip lever 125 and quiet operation of the service station 80, as well as returning the trip lever 25 to a neutral position. The service station 80 also has a tumbling or flip gear 130 formed as a stationary rack gear supported by the lower deck 82.

Figure 3:
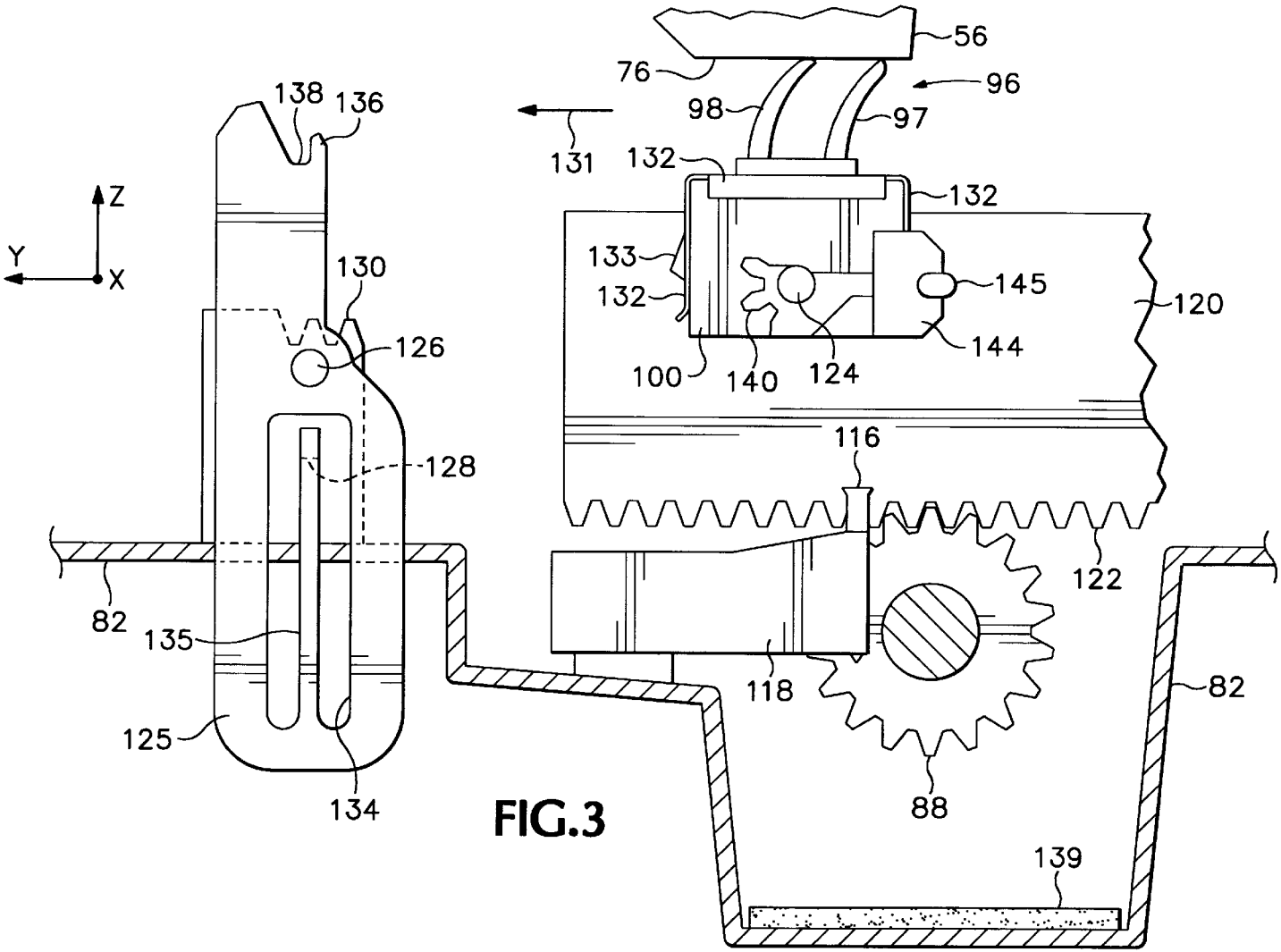
FIG. 3 is an enlarged, side elevational view of the service station of FIG. 1 shown with the wipers upright while wiping ink residue from an inkjet printhead.

FIG. 3 shows the color wiper assembly 96 wiping printhead 76 of pen 56. Prior to beginning the wiping cycle, preferably ink solvent from reservoir 101 is applied to the wiper assemblies 90–96 through rearward movement 108 of the pallet 120 which causes the wiper blades 97 to contact the solvent applicator pads 102–106, respectively. During the wiping stroke, the wiper assembly 96 is in an upright position with the spindle gear 88 engaging the pallet rack gear 122 to move the pallet bi-directionally, for instance in the rearward direction 108 and in a forward direction, as indicated by arrow 131.

FIG. 3 also shows more detail about the mounting of the wiper blades 97, 98 to the sled 100. Preferably, the wiper blades 97, 98 of assemblies 92–96 are onsert molded onto a stainless steel wiper mount 132, which is preferably snap fit over tabs 133 projecting from the sled 100. Similar mounting techniques for wiper blades have been used on earlier products, such as in the Hewlett-Packard Company's DeskJet® 720 and 722 color inkjet printers. FIG. 3 also shows other features of the trip lever 125, including an inverted U-shaped slot 134, which defines a spring arm 135 from which the stop 128 projects. The trip lever 125 also includes a thumb member 136, and a notch 138 which are used in the flipping-up operation of sled 100, to move the blades from an inverted position for scraping the wipers to the upright position for wiping, as described further below.

A couple of other features of the service station 80 are also shown in FIG. 3, including an absorbent liner 139 which rests along the bottom of the interior of the frame lower deck 82. The liner 139 may be of a cellulosic material or other equivalent materials known to those skilled in the art. FIG. 3 shows the sled 100 as having a sled flipping gear 140 which is centered around the sled pivot shaft 124. The flipping gear 140 engages the stationary flip gear 130 as described further below to rotate the sled 100 from the upright wiping position of FIG. 3, to an inverted scraping position. The sled 100 also includes a cantilevered support member 144 which extends outwardly beyond the pivot 124, that is, in the view of FIG. 3 out of the plane of the drawing sheet in the negative X-axis direction. Projecting further outwardly in the negative X-axis direction from the cantilevered support 144 is an oblong flip arm 145, which engages notch 138 of the trip lever during the flipping-up sequence as described further below. As described further below, the flip arm 145 also serves as a backup cam surface which is used to assure the wiper blades return to the upright position if other portions of the assembly fail to function as expected.

Figure 4:
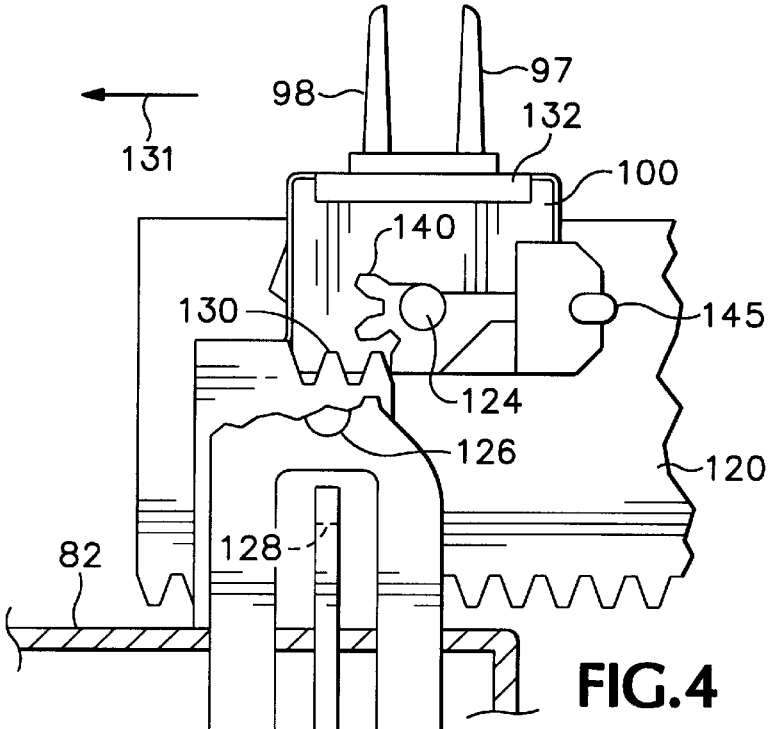
Figure 5:
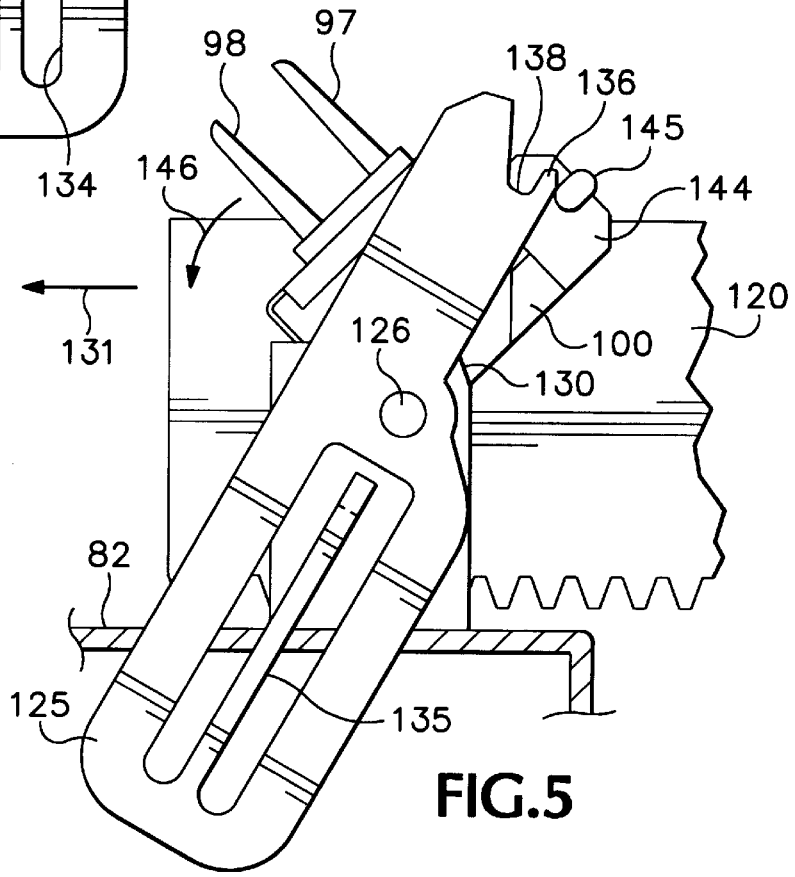

FIGS. 4–7 illustrate the flipping down sequence, where the wipers 90–96 move from the upright wiping position to the inverted scraping position. In FIG. 4, the pallet 120 has begun moving in the forward direction of arrow 131. FIG. 4 shows the fixed tumbling gear teeth 130 just before they are engaged with the sled flipping gear teeth 140. FIG. 5 shows the beginning of the flipping action, where gear teeth 130 and 140 are fully engaged, although this engagement is hidden by a portion of the trip lever 125 in FIG. 5. This engagement of teeth 130 and 140 has been caused by continued motion of the pallet 120 in the forward direction 131, which has caused the sled 100 to rotate in the direction of arrow 146. Also during this motion, the outer surface of the trip lever thumb 136 has been engaged by the flip arm 145, causing the trip lever 125 to rotate around pivot post 126 in the direction of arrow 146. This rotation of the trip lever 125 is used to place the lever in the proper position for use during the flip-up sequence.

Figure 6:
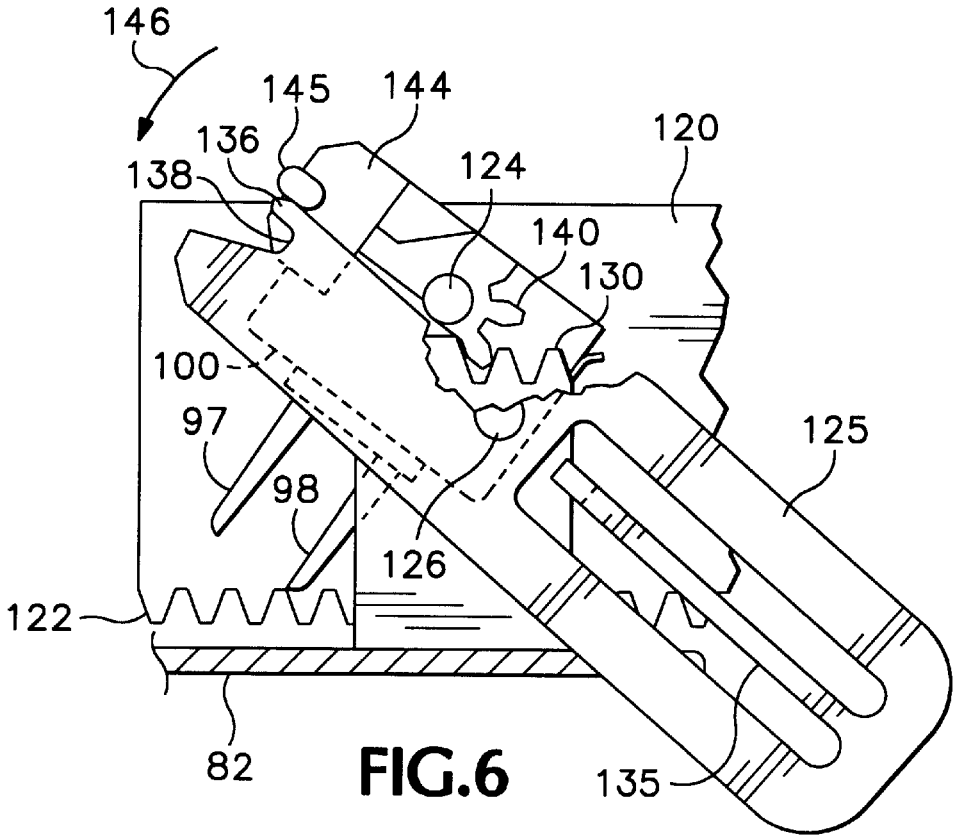
Figure 7:
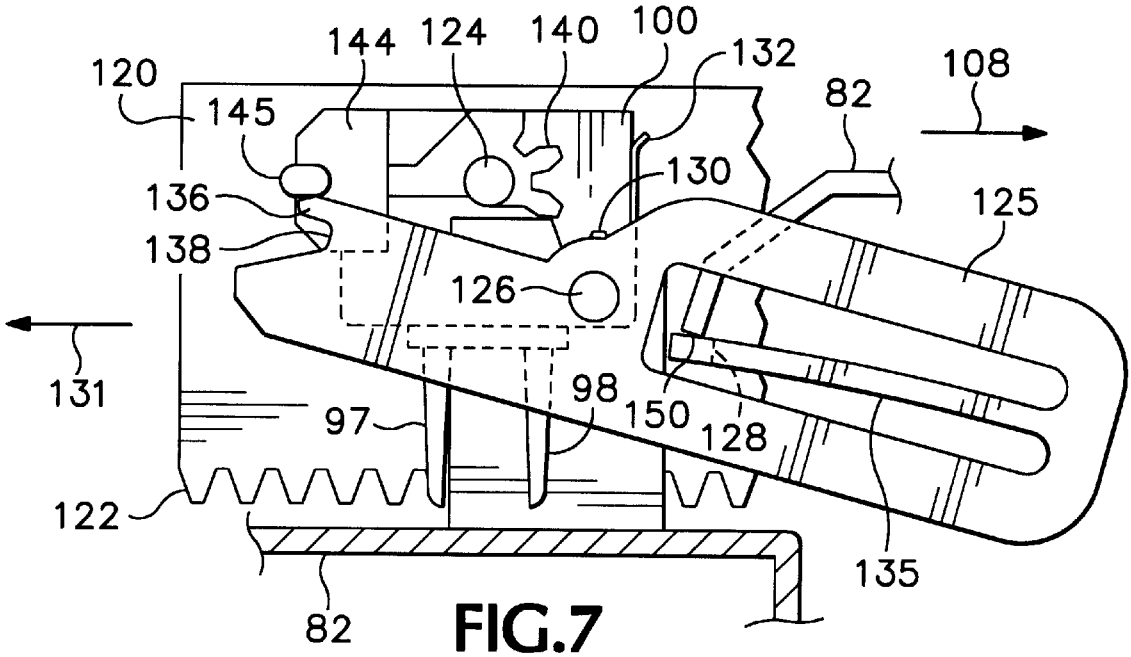

FIG. 6 shows further rotation of the sled 100 and the trip lever 125, both in the direction of arrow 146. In FIG. 6, we see the flipping gear teeth 130 and 140 in a latter stage of their engagement. FIG. 7 shows the completion of the flipping down sequence, where the wiper blades 97, 98 are now in an inverted position. The gear teeth 130, 140 are now completely disengaged and the flip arm rests on the outer surface of the trip lever thumb 136. FIG. 7 shows the trip lever stop 128 contacting a bumper stop member 150 which extends from the frame lower deck 82. The spring nature of the stop arm 135 serves to actively push the trip lever thumb 136 into engagement with the flip arm 145. Note, given the spring nature of the stop arm 135, any further motion of the pallet 120 in the direction of arrow 131 beyond the position of FIG. 7 causes the flip arm 145 to fall into notch 138, a step which is reserved for the flipping up sequence described further below. Thus, from the position of FIG. 7 the pallet 120 begins traversing, in the rearward direction of arrow 108 to begin the wiper scraping sequence.

Figure 8:
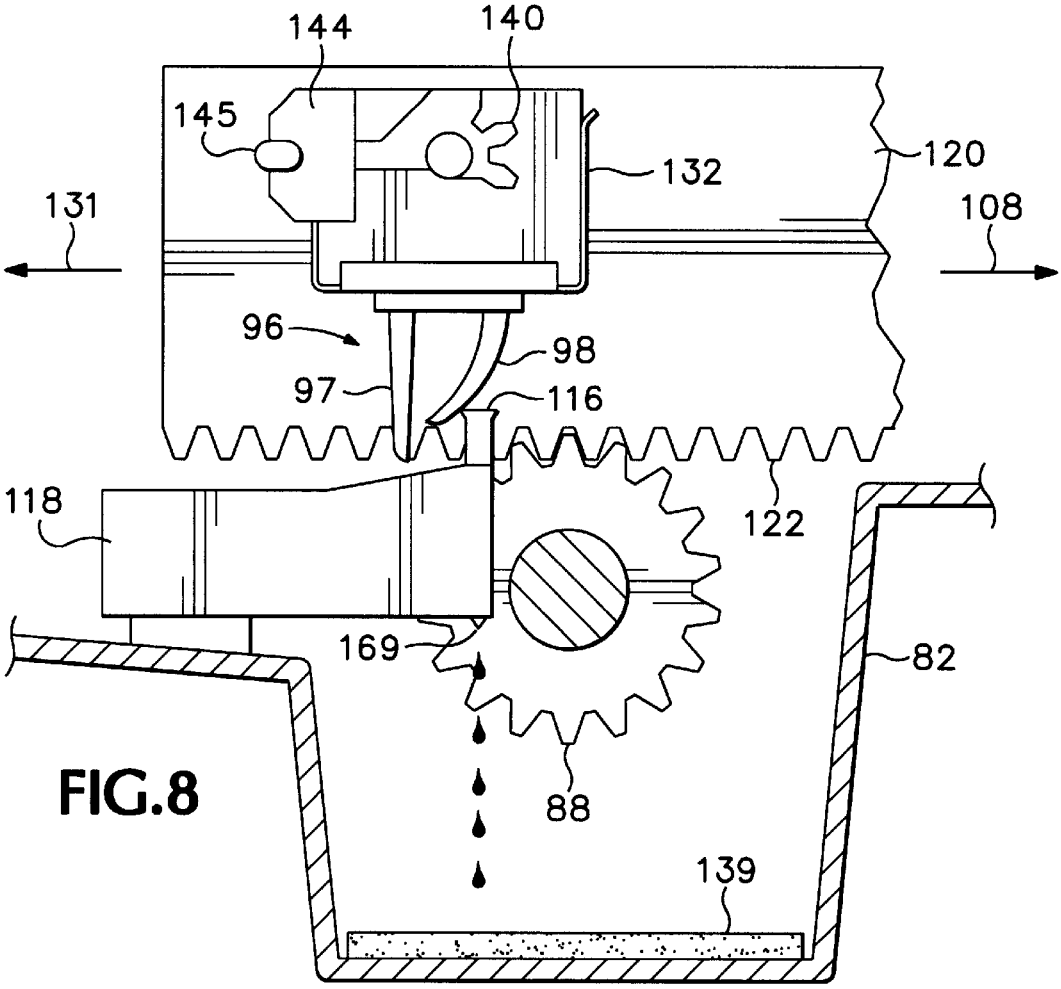
FIG. 8 is an enlarged, side elevational view of the service station of FIG. 1 showing the pallet inverted during a wiper scraping routine.

FIG. 8 shows the wiper scraping sequence, where the blades 97, 98 of the wiper assemblies 90–96 have ink residue scraped from their surfaces through contact with the scraper bars 110–116. From the position of FIG. 8, the pallet 120 continues to traverse in the rearward direction 108 until wiper blades 97 and 98 have had their rearward facing surfaces scraped by their associated scraper bars, such as scraper bar 116 which cleans wiper assembly 96. After the last wiper blade 97 has passed over the scraper bars, the pallet 120 stops and reverses direction to move in the forward direction 131 for a second phase of the scraping stroke. The frontward facing surfaces of wiper blades 97, 98 are scraped clean of ink residue by the scraper bar 116. In some scraping sequences, it may be desirable to repeat this forward and rearward motion several times, although in the preferred embodiment a single bi-directional scraping scheme is preferred.

Figure 10:
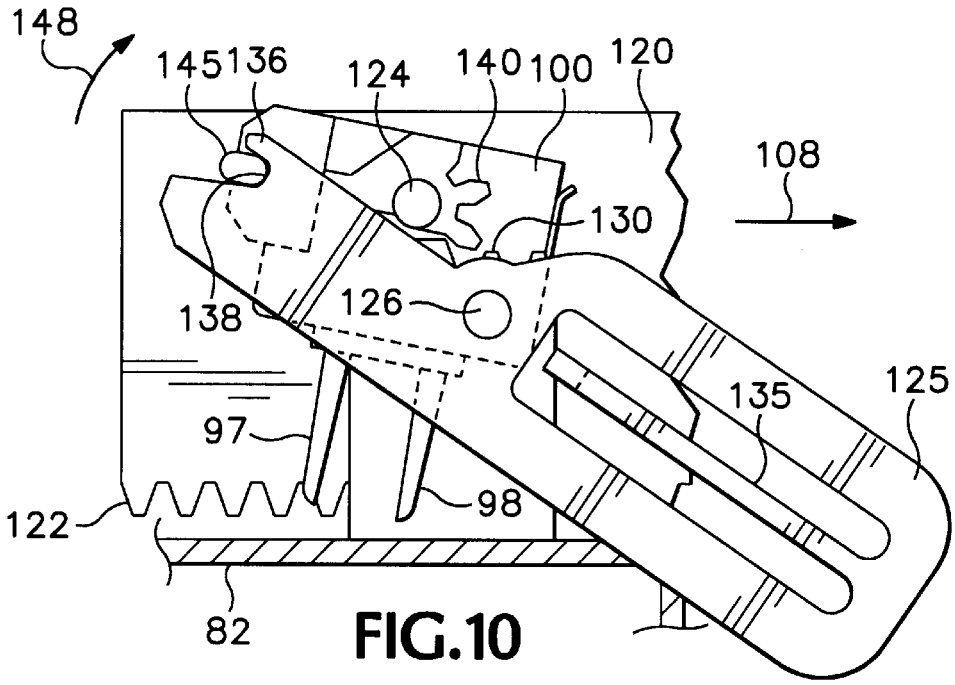

FIGS. 9–13 show the flipping up sequence which follows the scraping operation of FIG. 8. In comparing FIG. 9 with FIG. 7, it is seen that the pallet 120 in FIG. 9 has moved further in the forward direction 131 than in FIG. 7. This extreme forward motion of the pallet 120 has caused the flip arm 145 to move beyond the trip lever thumb 136. Under the biasing force supplied by the trip lever spring arm 135, and the engagement of the stop 128 with the frame bumper 150 (FIG. 7), the flip arm 145 has dropped down into a position ready to engage trip the lever notch 138, as shown in FIG. 10.

Figure 11:
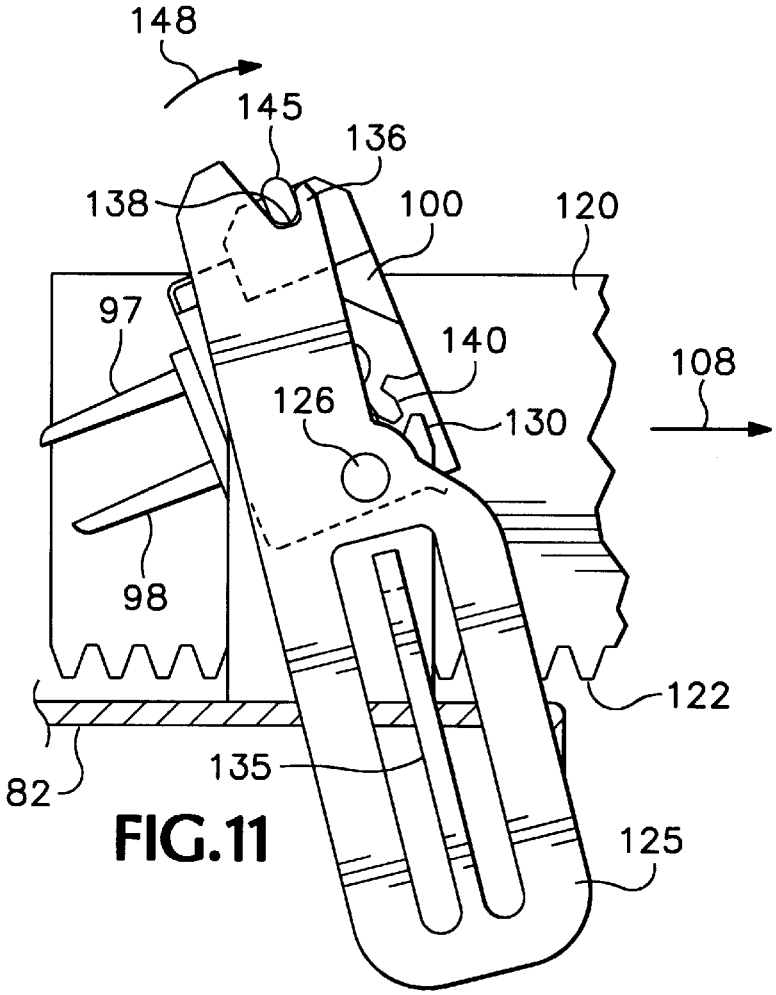

In FIG. 10, the pallet 120 has begun to move in the rearward direction 108, causing the sled 100 to begin pivoting around the shaft 124 in the direction of arrow 148. Through engagement of the flip arm 145 and the trip lever notch 138, this rearward motion of pallet 120 causes the trip lever 125 to pivot around post 126 also in the direction of arrow 148. Engagement of the flip arm 145 and the trip lever notch 138 forces the sled 100 to rotate into the upright position as the pallet 120 continues moving in the rearward direction 108, as shown in FIG. 11. This rotation of the sled 100 is also assisted by engagement of the flip gears 130 and 140.

Figure 12:
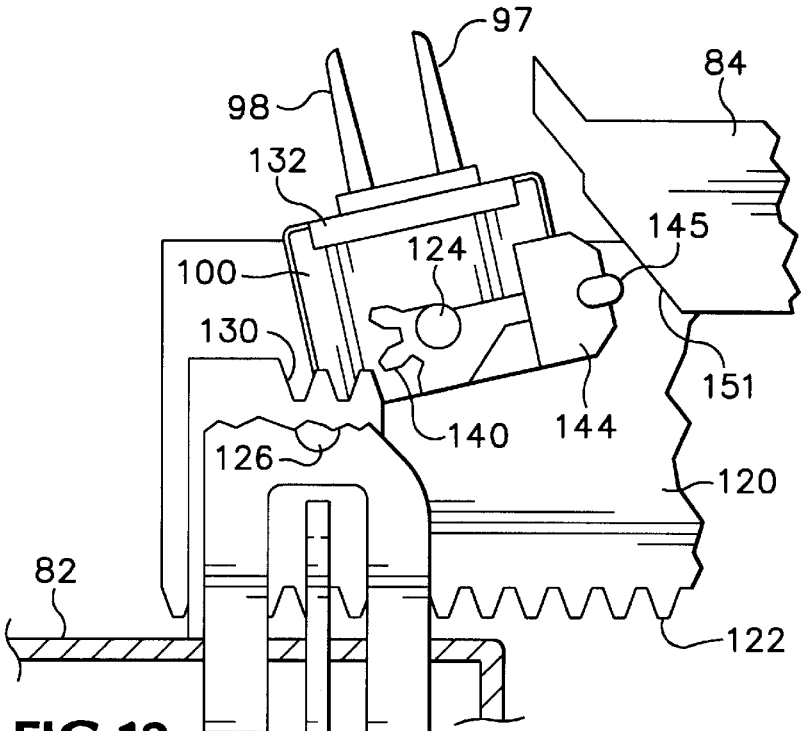
FIG. 12 showing a fourth stage.
Figure 13:
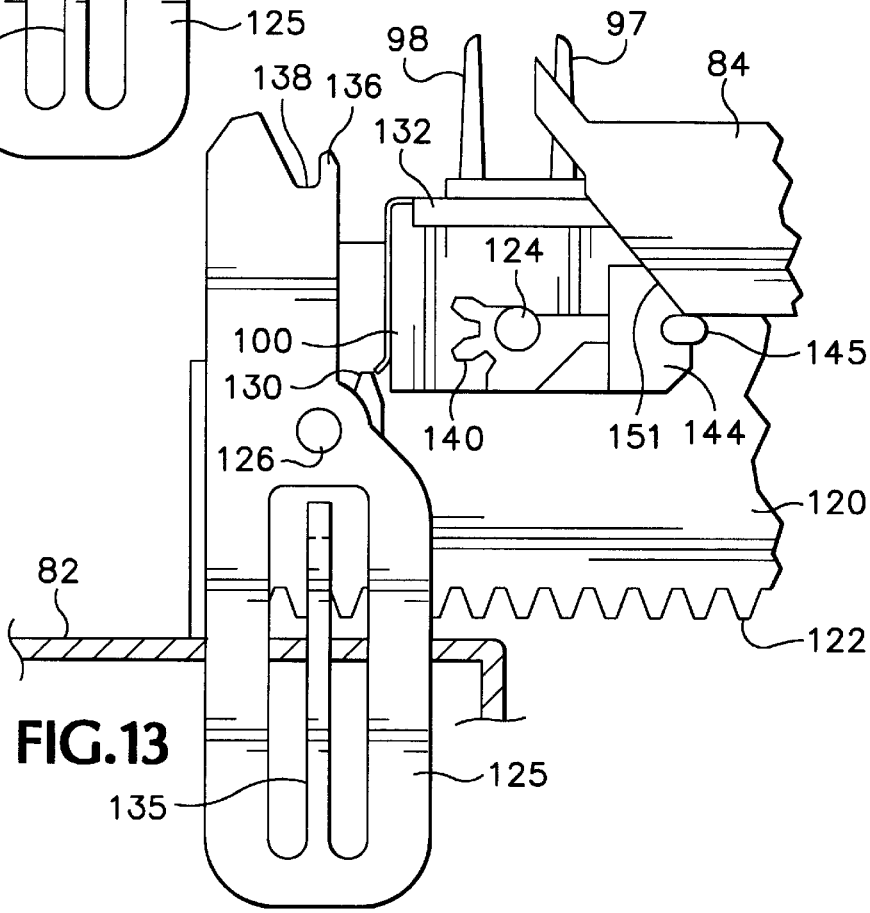
FIG. 13 showing a fifth stage.

FIG. 12 shows the sled 100 nearing the completion of its rotation in the direction of arrow 148. In FIG. 12, we see the flipping gears 130 and 140 are now disengaged. In prototype units, it was found that occasionally during this flipping up sequence, the sled 100 did not return to a fully upright position, remaining at a slight angle, as shown in FIG. 12. To accommodate these occasional instances where the sled 100 did not return to a full upright position, the backup cam surface of the flip arm 145 was formed to engage a cam surface 151 formed on a portion of the frame lower deck 82 during wiping and scraping. Following engagement of cam surfaces 145 and 151, FIG. 13 shows the sled 100 now in a fully upright position ready to perform a wiping stroke. To assist in aligning the sled 100 and pallet 120, as well as preventing the sled from rotating under torsional forces generated during the wiping and scraping operations, the flip arm 145 may ride along in a groove or slot (not shown) defined by the interior surface of the frame upper deck 84 and/or the frame lower deck 82. In FIG. 13, the trip lever 125 has been left in a roughly upright position, awaiting, contact by the flip arm 145 for presetting, as described above with respect to FIGS. 5–7.

Figure 14:
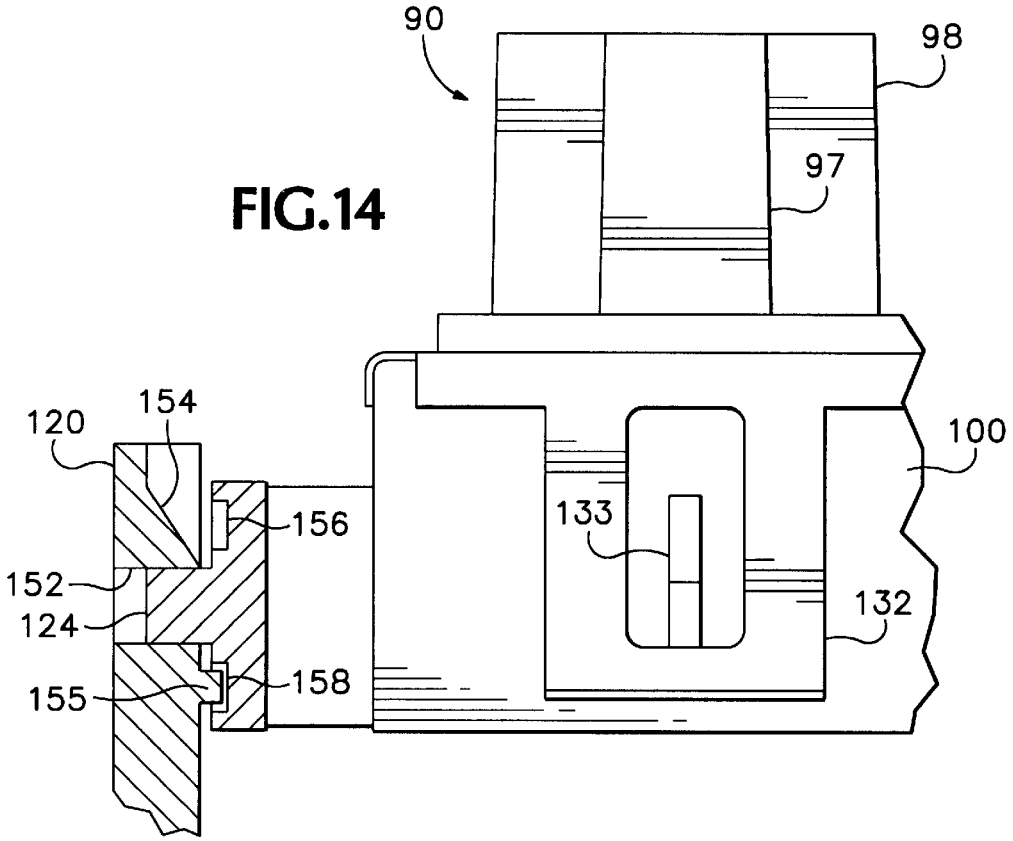
Figure 15:
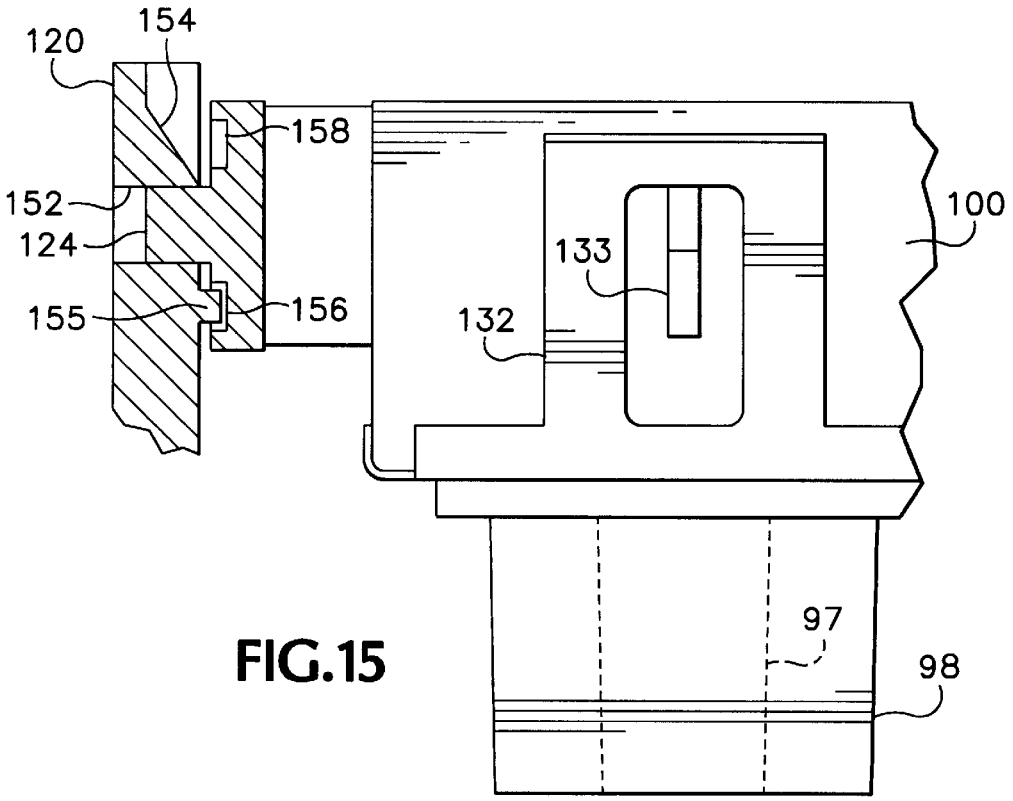

FIGS. 14 and 15 illustrate one manner of securing the sled 100 in the upright wiping position and in the inverted scraping position. One end of the sled pivot shaft 124 is shown riding within a bushing member 152 defined by pallet 120. The bushing portion 152 includes a guide ramp 154 which is used during assembly to flex this portion of the pallet outwardly as the sled is snapped into place. The opposite end of the sled 100 may be assembled to the pallet 120 in a similar fashion. The pallet 120 has a projection or detent member 155 which fits into either one of two slots 156 or 158 formed within the sled 100. As shown in FIG. 14, to secure the wiper blades in the upright wiping position, the detent 155 is engaged with slot 158. The wiper blades 97, 98 are held in the inverted scraping position through engagement of detent 155 with slot 156, as shown in FIG. 15. Understanding now how the sled 100 is held in both the upright and inverted positions, it will be better appreciated the necessity of providing the backup cam surfaces 145 and 151 to force sled 100 into the upright position so projection 155 can fully engage slot 158.

FIGS. 16–19 illustrate one form of an indexing wiper scraper system 160, constructed in accordance with the present invention, which may be substituted for the fixed scraper assembly 118 shown in FIGS. 2 and 8. The indexing scraper system 160 has a reservoir 162 which resides along an interior bottom portion of the frame lower deck 82. The reservoir 162 is filled with an ink solvent 164, such as PEG or similar materials described above with respect to the solvent reservoir 101. Preferably, the scraper solvent 164 is the same solvent which is applied to the wiper blades 97 by the applicator pads 102, 104, 106 and 108 so chemical incompatibility is not an issue.

Figure 16:
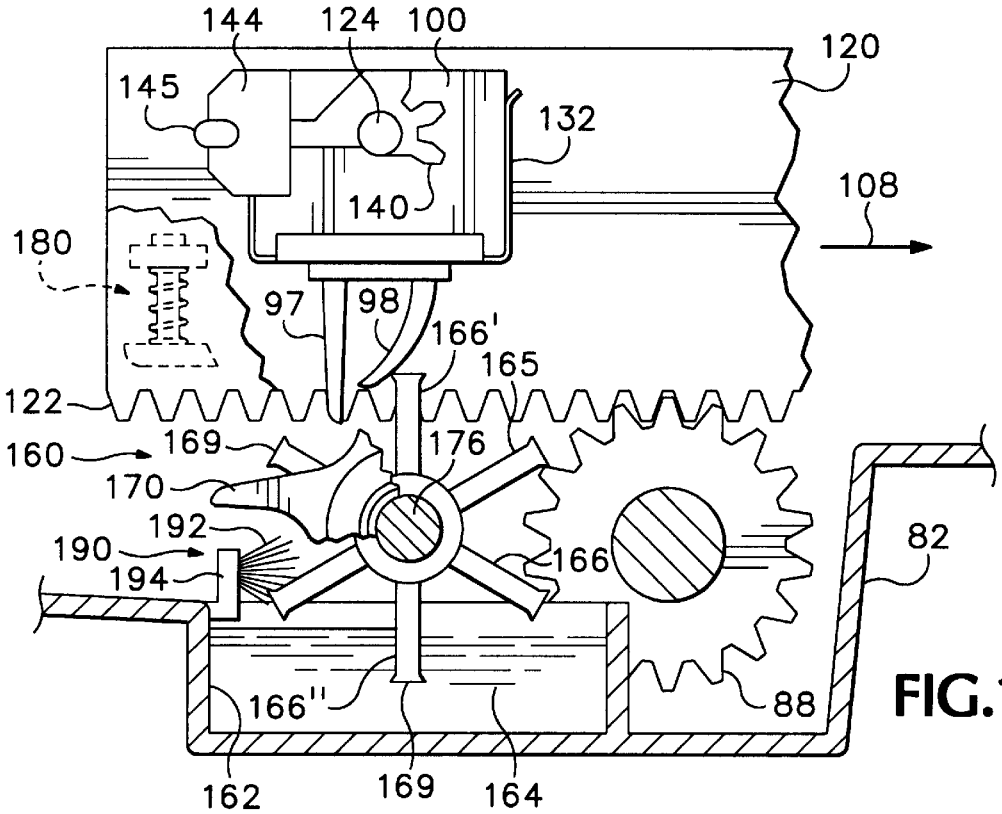
FIG. 16 is a side-elevational view of one form of an indexing wiper scraper system of the present invention which may be substituted for the fixed wiper scraper shown in FIGS. 2 and 8.

At the heart of the indexing wiper scraper system 160 is a rotating wiper scraper tumbler 165, which has a plurality of radial scraper bars 166 projecting outwardly from a cylindrical body member 168. Each of the scraper bars 166 terminates in a T-shaped head 169 which is believed to be quite efficient at removing ink residue from the wiper blades 97, 98, while also controlling ink residue flicking to undesirable locations inside the service station. FIG. 16 shows one of the scraper bars removing ink residue from the rearward facing surface of the wiper blade 98 as the pallet 120 moves in the rearward direction 108.

A ratchet mechanism shown as a ratchet wheel 170 is used to turn the scraper tumbler 165. As better shown in FIG. 17, the ratchet wheel 170 has a series of ratchet teeth 172, each of which has a passive surface 174 and an active surface 175. Both the ratchet wheel 170 and the scraper tumbler 165 are mounted on a shaft 176 to index the scraper tumbler 165 in the direction of arrow 178. In the illustrated embodiment, the ratchet wheel 170 is turned by a pawl member 180 that has a pawl head 182 mounted to a vertical shaft 184. A biasing member, for instance a coil spring 185, surrounds shaft 184 to push the pawl head 182 away from a mounting bracket 186 which is supported by the service station pallet 120. Preferably, the pawl shaft 184 is slidably mounted to the support bracket 186 to facilitate the ratcheting operation described below with respect to FIGS. 18 and 19. To further facilitate the ratcheting action, the pawl head 182 preferably has a rounded passive surface 188, and an angular active surface 189.

Another main component of the indexing scraper system 160 is a brush member 190. The brush 190 has clusters of brush bristles 192 projecting from a support member 194 which extends from a portion of the frame lower deck 82. The brush bristles 192 are located to remove any remaining ink residue and liquid PEG ink solvent 164 from the scraper bar heads 169 as they exit the solvent bath 164.

Figure 17:
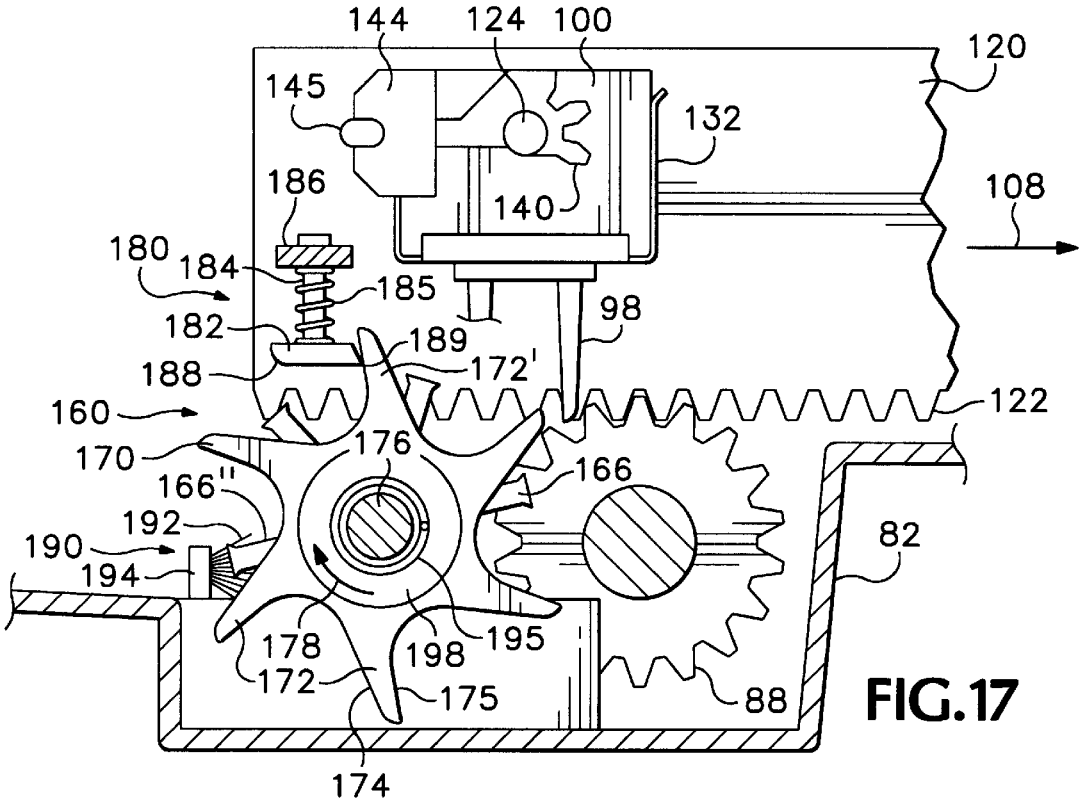
FIG. 17 is a side-elevational view of the indexing wiper scraper system of FIG. 16, shown with a ratchet mechanism indexing the scraper blades.
Figure 18:
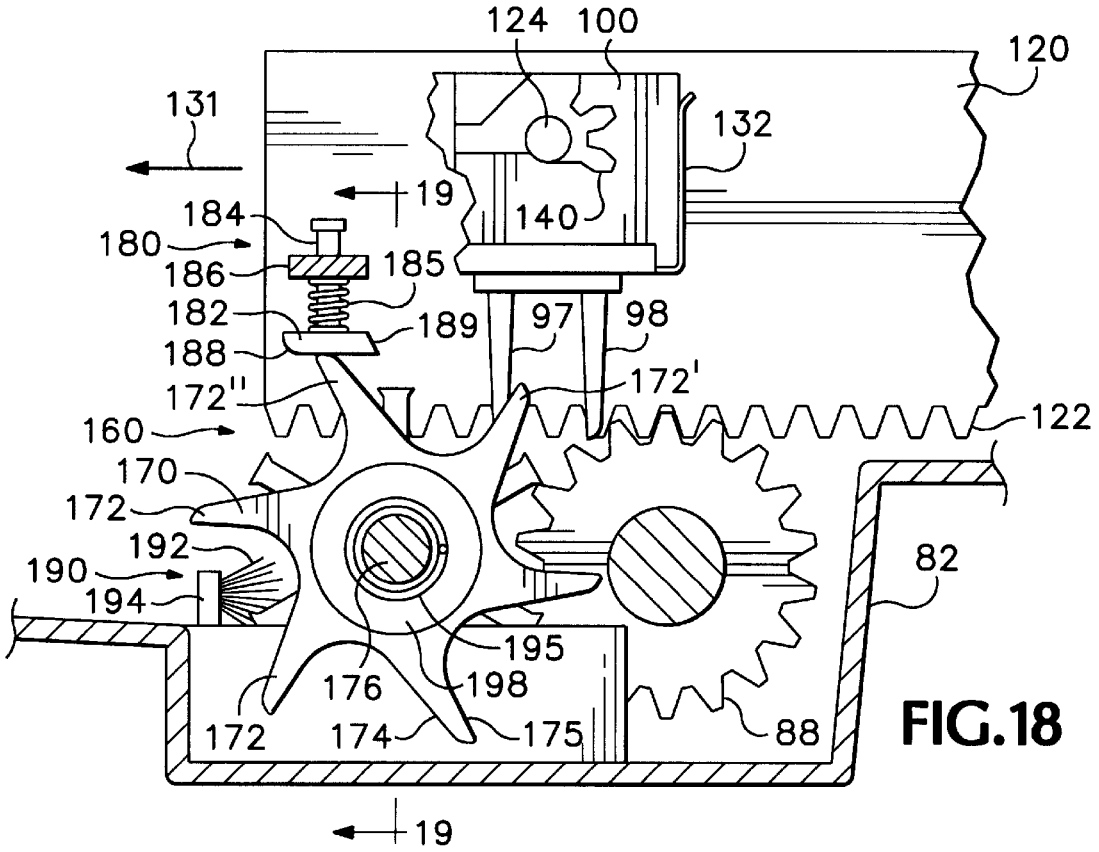
FIG. 18 is a side-elevational view of the indexing wiper scraper system of FIG. 16, shown during a resetting stroke of the ratchet mechanism.

The ratcheting operation will now be explained with reference to FIGS. 17 and 18, with FIG. 17 showing an active ratcheting stroke and FIG. 18 showing a passive resetting stroke. In the active stroke of FIG. 17, the active surface 189 of the pawl head 182 is brought into contact with the active surface 175 of one of the 5 ratchet teeth 172' as pallet 120 moves in the rearward direction 108. Contact of the pawl member 180 with a ratchet tooth active surface 175 causes the ratchet member 170 and the scraper tumbler 165 to rotate in the direction of arrow 178. Preferably, the ratchet teeth 172 are spaced and arranged to index the scraper tumbler 165 in increments of at least one scraper bar during one pass of the pallet 120.

FIG. 18 shows the resetting or passive stroke of pallet 120 in the forward direction 131. Here we see the passive surface 188 of the pawl head 182 has contacted the passive surface 174 of one of the ratchet teeth 172". This contact of the pawl head 182 with the ratchet tooth 172" causes the pawl spring 185 to be compressed as the shaft 184 slides upwardly through the mounting bracket 186 because the pawl head 182 rides up over the crest of the engaged ratchet tooth 172".

Figure 19:
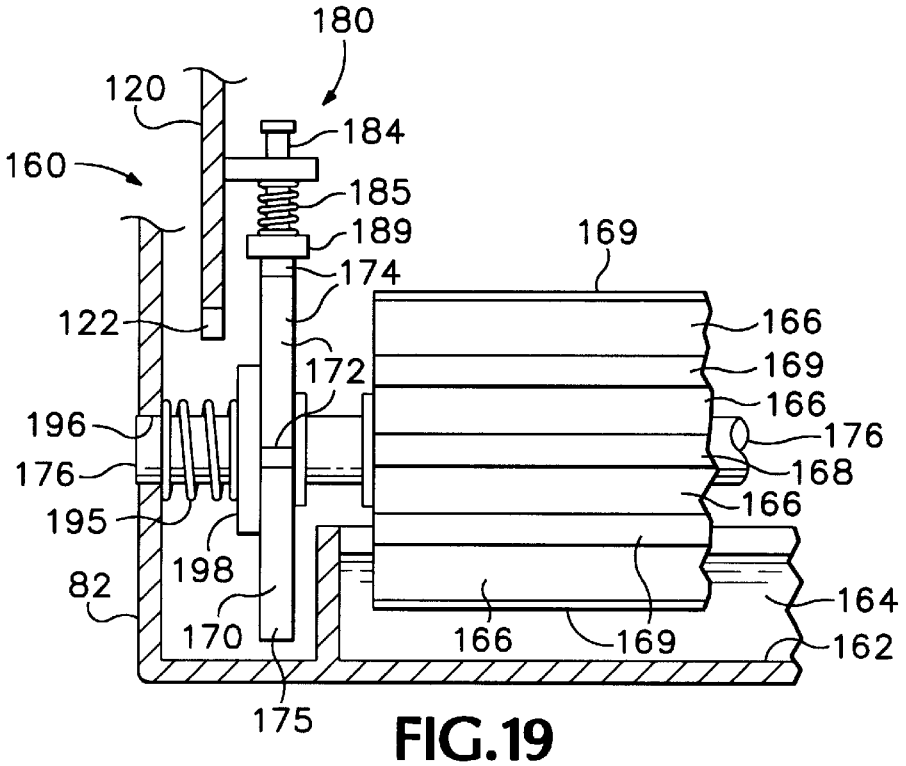
FIG. 19 is a rear-elevational view taken along lines 19—19 of FIG. 18.

During this passive resetting stroke, the scraper tumbler 165 and the ratchet member 170 are prevented from rotation in a direction opposite arrow 178 through the use of a biasing member, such as a coil spring 195 which is best shown in FIG. 19. The end of the tumbler shaft 176 projects through a shaft support, such as bushing 196 which may be formed within the frame lower deck 82. To prevent the biasing spring 195 from rubbing against the ratchet wheel 170, a disk 198 may be used to surround shaft 176 between the spring 195 and the ratchet wheel 170.

In operation, following dabbing of the wipers 90–96 against the ink solvent applicator pads 102–106, the printheads 70–76 are wiped. Following printhead wiping, the wiper sled 100 undergoes the flip-down sequence shown in FIGS. 4–7. FIG. 16 then shows the wipers being cleaned by the most upright scraper bar 166'. Opposite the active scraper bar 166' is a soaking scraper bar 166", which is soaking in the ink solvent bath 164. A first stage of the scraping stroke is shown in FIG. 16, where the pallet 120 is moving in the rearward direction 108. Before the pawl mechanism 180 encounters one of the ratchet teeth 172', and after wiping the rearward facing surface of both blades 97 and 98, pallet 120 reverses direction. Following this direction reversal, the pallet 120 moves in the forward direction of arrow 132 to clean the forward facing surfaces of blades 97 and 98 in a second stage of this bidirectional scraping stroke.

After the forward facing surfaces of the wiper blades 97, 98 are cleaned, the pallet 120 again moves in the rearward direction 108 so the active surface 189 of the pawl head 182 engages the active surface 175 of the most upright ratchet tooth 172'. Rearward motion 108 of the pallet 120 continues until the ratchet wheel 170 and scraper tumbler 165 are in the position shown in FIG. 18 and the pawl head 182 disengages the ratchet tooth 172'. Here, the biasing spring 195 holds the ratchet wheel 170 and tumbler 165 in place during the passive stroke of the pallet 120. As mentioned above, the pawl head 182 floats over the passive surface of tooth 172", as shaft 184 moves upwardly through the support bracket 186, and spring 185 is compressed. Returning to FIG. 17, during the active ratcheting stroke, the indexing action of the scraper tumbler 165 being rotated brings a fresh scraper bar 166" out of the solvent bath 164 and into cleaning contact with the bristles 192 of brush member 190. Any ink residue remaining clinging to the scraper bar 166", along with excess ink solvent clinging to the bar, are removed by the brush bristles 192 during the active ratcheting stroke.

It is apparent that in some implementations it may be desirable to replace the ratcheting mechanism with some other type of tumbler advancing mechanism, such as a dedicated motor, or a motor and gear assembly. Furthermore, while the solvent bath 164 is preferred to be used, in some implementations it may be unnecessary. Additionally, the brush member 190 may be omitted in some systems, or located in other positions, such as within the solvent bath 164.

Conclusion

Thus, a variety of advantages are realized using the flipping wiper scraper service station 80, and several of these advantages have been noted above. For example, use of the flipping mechanism described in FIGS. 2–15 advantageously allows the controller 40 to have complete knowledge of the mechanical state of the service station 80 through counting the steps of motor 85, without requiring extra position sensors or feedback mechanisms. Furthermore, the service station 80 only needs a single motor 85 to accomplish the servicing functions which some earlier service stations needed two or more motors to accomplish. Thus, needing fewer motors and no position sensors, the flipping service station 80 is lower in cost to manufacture than earlier service stations.

A variety of advantages are realized using the indexing scraper system 160. Using the indexing scraper system 160 with the solvent bath 164 results in a cleaner scraper 166' being available to clean ink residue from the wiper blades 97, 98. Thus, the scraper bars 166 are much cleaner and more effective in removing ink residue from the wiper blades 97, 98 than earlier systems using fixed stationary wiper scrapers. Thus, by prolonging the cleaning life of the wiper scrapers, the wiper blades 97, 98 retain their ability to adequately clean the printheads 70–76 for a longer duration than the earlier stationary scraper bars. Longer wiper life leads to prolonged printhead life, particularly in a printer using permanent or semi-permanent printheads, the end result is a longer life printer 20 for consumers.

The inventive concepts described herein by way of the illustrated embodiments in FIGS. 1–19 maybe implemented in a variety of different ways which still fall within the scope of the claims below. For instance, while the wipers are shown being flipped from an upright primary wiping operation to a secondary scraping operation below, in some service stations, such as those having caps or primers, it may be desirable to flip either the caps or primers under the pallet for a secondary operation, such as for blotting ink residue from the interior of the caps or primers. Thus, while illustrated in terms of wipers and scrapers, the broader concept of the flipping service station 80 is to perform a primary servicing operation upon printheads 70–76, and a secondary operation on the servicing component when the pallet is flipped to the inverted position, thus readying the servicing component for the next servicing operation.

I claim:

1. A wiper cleaning system for cleaning ink residue from a wiper which has wiped ink residue from an inkjet printhead in an inkjet printing mechanism, comprising:

a frame;

a scraper tumbler having a body pivotally supported by the frame and plural scraper bars projecting radially outward from the body;

a tumbler advancing mechanism which selectively advances the scraper bars to a scraping position where the wiper is scraped across a positioned one of the scraper bars;

a reservoir defined by the frame; and an ink solvent contained within the reservoir to form a solvent bath;

wherein the advancing mechanism selectively advances the scraper bars to a soaking position where at least one of the scraper bars is soaking in the solvent bath.

2. A wiper cleaning system according to claim 1 further including a brush member located to contact at least one of the scraper bars when selectively advanced by the advancing mechanism.

3. A wiper cleaning system according to claim 2 wherein:

the reservoir has an entrance which receives the scraper bars when selectively advanced by the advancing mechanism, and an exit portion through which the scraper bars leave the reservoir when selectively advanced by the advancing mechanism; and the brush member is located at the reservoir exit portion.

4. A wiper cleaning system according to claim 1 wherein the advancing mechanism comprises a ratchet mechanism which selectively advances the scraper blades through an indexing motion.

5. A wiper cleaning system according to claim 4 wherein said indexing motion of the ratchet mechanism has a ratcheting stroke which selectively advances the scraper bars by one scraper bar position.

6. A wiper cleaning system according to claim 4 further including a moveable platform which supports the wiper, with the platform having a pawl which engages the ratchet mechanism to selectively advance the scraper blades through said indexing motion.

7. A method of cleaning ink residue from an inkjet printhead in an inkjet printing mechanism, comprising the steps of:

providing a wiper, a scraper tumbler having plural scraper bars projecting radially outward therefrom, and a reservoir filled with an ink solvent contained to form a solvent bath;

wiping ink residue from said inkjet printhead with the wiper;

rotating the scraper tumbler to place one of the scraper bars in a scraping position;

moving the wiper across said one of the scraper bars to scrape ink residue from the wiper; and selectively soaking at least one of the scraper bars in the solvent bath.

8. A method according to claim 7 wherein:

the providing step further includes the step of providing a brush member; and the method further includes the step of brushing at least one of the scraper bars during the rotating step.

9. A method according to claim 8 wherein the brushing step follows the soaking step.

10. A method according to claim 7 wherein the rotating step comprises the step of ratcheting the scraper tumbler through an indexing motion.

11. A method according to claim 10 wherein said indexing motion selectively advances the scraper bars by one scraper bar position.

12. A method according to claim 10 wherein:

the providing step further includes the step of providing a moveable platform which supports the wiper; and the rotating step comprises the step of engaging the scraper tumbler with the platform.

13. An inkjet printing mechanism, comprising:

a frame;

an inkjet printhead supported by the frame for movement between printing positions for printing and a servicing position for receiving printhead servicing;

a wiper which wipes ink residue from the printhead during a wiping stroke when the printhead is in the servicing position;

a platform which supports the wiper for movement through a wiping stroke to wipe the ink residue from the printhead and a scraping stroke;

a scraper tumbler having a body pivotally supported by the frame and plural scraper bars projecting radially outward from the body;

a tumbler advancing mechanism which selectively advances the scraper bars to a scraping position where the wiper is scraped across a positioned one of the scraper bars during the scraping stroke;

a reservoir defined by the frame; and an ink solvent contained within the reservoir to form a solvent bath;

wherein the advancing mechanism selectively advances the scraper bars to a soaking position where at least one of the scraper bars is soaking in the solvent bath.

14. An inkjet printing mechanism according to claim 13 further including a brush member located to contact at least one of the scraper bars when selectively advanced by the advancing mechanism.

15. An inkjet printing mechanism according to claim 13 wherein the advancing mechanism comprises a ratchet mechanism which selectively advances the scraper blades through an indexing motion.

16. An inkjet printing mechanism according to claim 15 wherein said indexing motion of the ratchet mechanism has a ratcheting stroke which selectively advances the scraper bars by one scraper bar position.

17. An inkjet printing mechanism according to claim 15 wherein the platform has a pawl which engages the ratchet mechanism to selectively advance the scraper blades through said indexing motion.

* * * * *